US006261022B1

(12) United States Patent
Dalebout et al.

(10) Patent No.: US 6,261,022 B1
(45) Date of Patent: Jul. 17, 2001

(54) ADJUSTABLE DUMBBELL AND SYSTEM

(75) Inventors: William T. Dalebout, Logan, UT (US); Patrick J. Hald, Los Osos, CA (US); Rodney Hammer, Lewiston, UT (US)

(73) Assignee: Icon Health & Fitness, Inc., Logan, UT (US)

( * ) Notice: Subject to any disclaimer, the term of this patent is extended or adjusted under 35 U.S.C. 154(b) by 0 days.

(21) Appl. No.: 09/247,160

(22) Filed: Feb. 9, 1999

Related U.S. Application Data

(63) Continuation-in-part of application No. 09/042,755, filed on Mar. 17, 1998.

(51) Int. Cl.[7] ..... A63B 21/075
(52) U.S. Cl. ..... 402/107; 482/108
(58) Field of Search ..... 482/106–108, 482/23

(56) References Cited

U.S. PATENT DOCUMENTS

| | | | |
|---|---|---|---|
| D. 359,778 | 6/1995 | Towley, III et al. | D21/197 |
| 4,529,198 | 7/1985 | Hettick, Jr. | 482/107 |
| 4,822,035 | 4/1989 | Jennings et al. | 272/123 |
| 5,637,064 | 6/1997 | Olson et al. | 482/108 |
| 5,769,762 | 6/1998 | Towley, III et al. | 482/93 |
| 5,779,604 | 7/1998 | Towley, III et al. | 482/108 |
| 5,839,997 * | 11/1998 | Roth et al. | 482/107 |
| 6,033,350 * | 3/2000 | Krull | 482/98 |
| 6,099,442 * | 8/2000 | Krull | 482/107 |

FOREIGN PATENT DOCUMENTS

| | | | |
|---|---|---|---|
| 1258447 | 9/1986 | (SU) | 482/93 |

OTHER PUBLICATIONS

PowerBlock, *The World's Only Selectorized Dumbbell*, 1995 IntellBell, Inc.

* cited by examiner

*Primary Examiner*—John Mulcahy
(74) *Attorney, Agent, or Firm*—Workman Nydegger & Seeley; Jonathan W. Richards; David B. Dellenbach

(57) ABSTRACT

A weight lifting system features (i) one or more weights; and (ii) a weight lifting bar configured to selectively engage the one or more weights. The weight has an upstanding first end, an upstanding second end, and at least one and preferably a pair of cross members extending therebetween. The weight lifting bar includes a handle having (i) a grip; and (ii) a cross member coupled to the grip. A gripping member is rotatably coupled to the cross member. Upon rotation of the gripping member, the handle selectively grips the cross members of a selected weight or weights. The weights can then be lifted by a user.

21 Claims, 9 Drawing Sheets

ADJUSTABLE DUMBBELL AND SYSTEM

CONTINUING APPLICATION DATA

This application is a continuation-in-part from a United States Patent Application entitled "Adjustable Dumbbell and System" to Hald, et al, application Ser. No. 09/042,755 which was filed on Mar. 17, 1998 and which is incorporated herein in its entirety by reference.

BACKGROUND OF THE INVENTION

1.The Field of the Invention

This invention is in the field of weight lifting equipment. More specifically, this invention is in the field of hand-held weights.

2. The Relevant Technology

Hand-held weights such as barbells and dumbbells have been used for many years by exercisers engaging in weightlifting. Some hand-held weight systems include a bar configured to removably receive a variety of different weights which slide onto the bar. Other weight systems include a handle and disks integrityrally attached on opposing sides of the handle.

It is common for commercial gyms and home gyms to include barbells or dumbbells which are stored on a bench or on the floor. These hand-held weights are used for exercises such as a military press to strengthen the upper body, curls to strengthen the biceps, and squats to strengthen the upper and lower body. Sometimes dumbbells are held while jogging or running in place to enhance the exercise experience.

While lifting a weight which is too small may not provide the adequate training desired by a user, lifting a weight which is too heavy may strain or injure the user. The exerciser may be interested in lifting a lighter weight on one day, then ramp up to a heavier weight on another day. Thus, for the sake of safety and for the appropriate amount of exercise, it is useful to provide a variety of options for the exerciser.

In order to permit a number of different users to lift handweights, it is common for gyms to provide a variety of different weights and sizes of integral or adjustable weights. Despite the advantages of having a variety of different handweights, however, providing an assortment of different handweights is expensive and increases the amount of storage space required. In order to use space more efficiently, gyms typically include a shelf or cabinet for receiving differently-sized handweights.

In the event a weight bench or cabinet is not employed, the user is often forced to leave the weights on the floor, which is a highly inefficient use of space and provides a cluttered appearance. Thus, in order to use space more efficiently, the user is required not only to purchase the assortment of handweights but must also purchase a bench or cabinet for storing the various handweights.

Another problem within the art is that it is often cumbersome to mount weights onto a bar. Weights sometimes include holes therein and are disposed about the bar without being otherwise secured to the bar. One disadvantage with these weights is that it is possible for one or both of the weights on opposing sides of the bar to fall off. This can be inconvenient or even dangerous for the user or for a person adjacent to the user such as a spotter or coach.

For example, if the exerciser is lying on a bench performing a military press and a weight on one side of a bar falls off the bar, the weight on the other side of the bar causes the bar to tip toward the weighted side. If this action occurs suddenly, the non-weighted side can be quickly thrust toward the weighted side, possibly causing injury or damage.

In other embodiments, weights are prevented from falling from a bar through the use of screws disposed through circular brackets coupled outside the weights to the bar. These mechanisms, however, are often inconvenient to mount onto the bar and remove from the bar. Each of these mechanisms must be placed onto the bar separately and on opposing sides of the bar. Another problem within the art is the expense of purchasing separate pieces of equipment for each different weight desired to be used by the weightlifter.

One product known as the POWERBLOCK attempts to provide a selectorized dumbbell which allows a user to select a desired weight to be lifted from a set of stacked weights. A user inserts a core having an internal band grip into a set of stacked weights, then selects a desired number of weights using a selector pin.

The POWERBLOCK however, interferes with the natural movement of the user's wrists and has an unusual rectangular block appearance. The user must reach into the rectangular structure to pick up the weights. As a result, the rectangular structure can inconveniently contact the wrists during use. In addition, the removable selector pin can be lost or misplaced and is inconvenient to orient into and remove from the weights. The pin must also be mounted from a location remote from the location where the practitioner grasps the handle.

SUMMARY AND OBJECTS OF THE INVENTION

It is therefore an object of the present invention to provide an improved weightlifting system.

It is another object of the invention to provide an improved weightlifting bar.

It is another object of the invention to provide an improved weight.

It is another object of the invention to provide a weightlifting system which selectively, conveniently allows a user to adjust the weight of the weightlifting system.

It is another object of the invention to provide a weightlifting system which includes a plurality of weights which are removably coupled to a weightlifting bar.

It is another object of the invention to provide a weightlifting bar which conveniently allows a user to add additional weights or remove excess weights from the weightlifting bar.

It is another object of the invention to eliminate unnecessary expense on separate pieces of weightlifting equipment.

It is another object of the invention to eliminate wasted storage space in exercise gyms.

The present invention relates to a weightlifting system comprising (i) one or more weights; and (ii) a weightlifting bar configured to selectively engage the one or more weights. A weight of the present invention has an upstanding first end, an upstanding second end, and a cross member extending therebetween. Each of the first and second ends of the weight has an aperture therethrough.

The weightlifting bar comprises (i) a handle having opposing ends; and (ii) means for selectively attaching each end of the handle to a corresponding end of the weight when the handle is disposed between the first end and second end of the weight. The means for selectively attaching each end of the handle to a corresponding end of the weight preferably comprises: (i) a pinion gear rotatably disposed within a channel of the handle; (ii) a first rod movably disposed within the channel; and (iii) a second rod movably disposed within the channel. Each rod has teeth formed along a length thereof which engage the pinion gear.

By selectively moving one of the rods, the user manually advances both rods through opposing ends of the handle. Thus, the rods pass through respective apertures in the first and second ends of the weight, removably coupling the weight to the handle.

The invention further includes a second weight configured to receive the first weight between the ends thereof in a nested relationship. In this nested relationship, the apertures in the upstanding ends of the first and second weights are in axial alignment. This allows the rods to pass through the apertures in both weights when the user desires to lift both weights. One or both weights is then conveniently removed from the weight lifting bar by manually retracting the rods out of one or both weights.

In one embodiment, the rods are advanced in desired increments out of opposing ends of the handle. In order to advance the rods in desired increments, the handle includes a plurality of longitudinally aligned slots formed within the channel. A knob on one of the rods is configured to selectively engage a pair of desired slots. This maintains each rod in a desired orientation with respect to the handle until the knob is selectively moved from that orientation to another pair of slots by the user. Each slot is separated by a tooth extending between neighboring slots. The knob is spring-loaded such that the knob is selectively depressed in order to move the knob between slots. Preferably, the handle includes first and second rows of longitudinally aligned slots.

The weightlifting system of the present invention enables the user to select a desired number of weights to be lifted, then readily couple the weights to the weightlifting bar without concern that the weights will fall off, and without having to screw brackets onto different sides of the bar and unscrew the brackets when adjustment is desired. If certain weights are not selected, they are maintained in a nested relationship with respect to each other, thereby conserving space. Furthermore, adjustment of the weights coupled to the handle can be accomplished using a single hand. The user conveniently presses a knob with the user's thumb or finger, thereby advancing the rods out of the handle and into a desired number of weights.

In addition, when the user desires to remove certain weights from the weightlifting bar, the user is able to readily do so and leave the excess weights in the nested relationship with other weights. The weightlifting system thus conserves space, provides for easy adjustment of weights, and maintains weights on the bar without risk of the weights falling off.

In another embodiment of the present invention, the weight lifting bar includes: (i) a handle having a grip and a cross member coupled to and spaced apart from the grip; and (ii) a gripping member rotatably coupled to the cross member of the handle. The gripping member is configured to selectively couple at least one, and preferably a pair of cross members of a weight to the handle.

The gripping member is preferably a finger-shaped member which can be extended between the cross members of the nested weights and then below the plane of the cross members of the weights. While below the plane of the cross members of the weights, the gripping member selectively rotates, thereby sandwiching a selected number of cross members of weights between the finger-shaped member and the ends of the handle. The gripping member is one example of means rotatably coupled to the handle for selectively coupling the weight to the handle when the handle is disposed between the first end of the weight and the second end of the weight.

The weight lifting system also comprises means for incrementally rotating the gripping member, such as one or more detentes configured to contact a plate coupled to the gripping member. The detentes enable incremental rotation of the gripping member. The weight lifting system also comprises means for preventing rotation of the gripping member past a desired position.

The weight lifting system comprising the rotating gripping member is convenient to use. Engagement of a weight to the handle can be achieved by placing the cross member of the handle between the cross members of the weight, such that the gripping member is below the plane of the cross members of the weight, then rotating a tab or handle coupled to the gripping member. The tab can be oriented so as to be within or close to within reach of the user of the weight. This rotates the gripping member under the desired number of cross members of weights.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
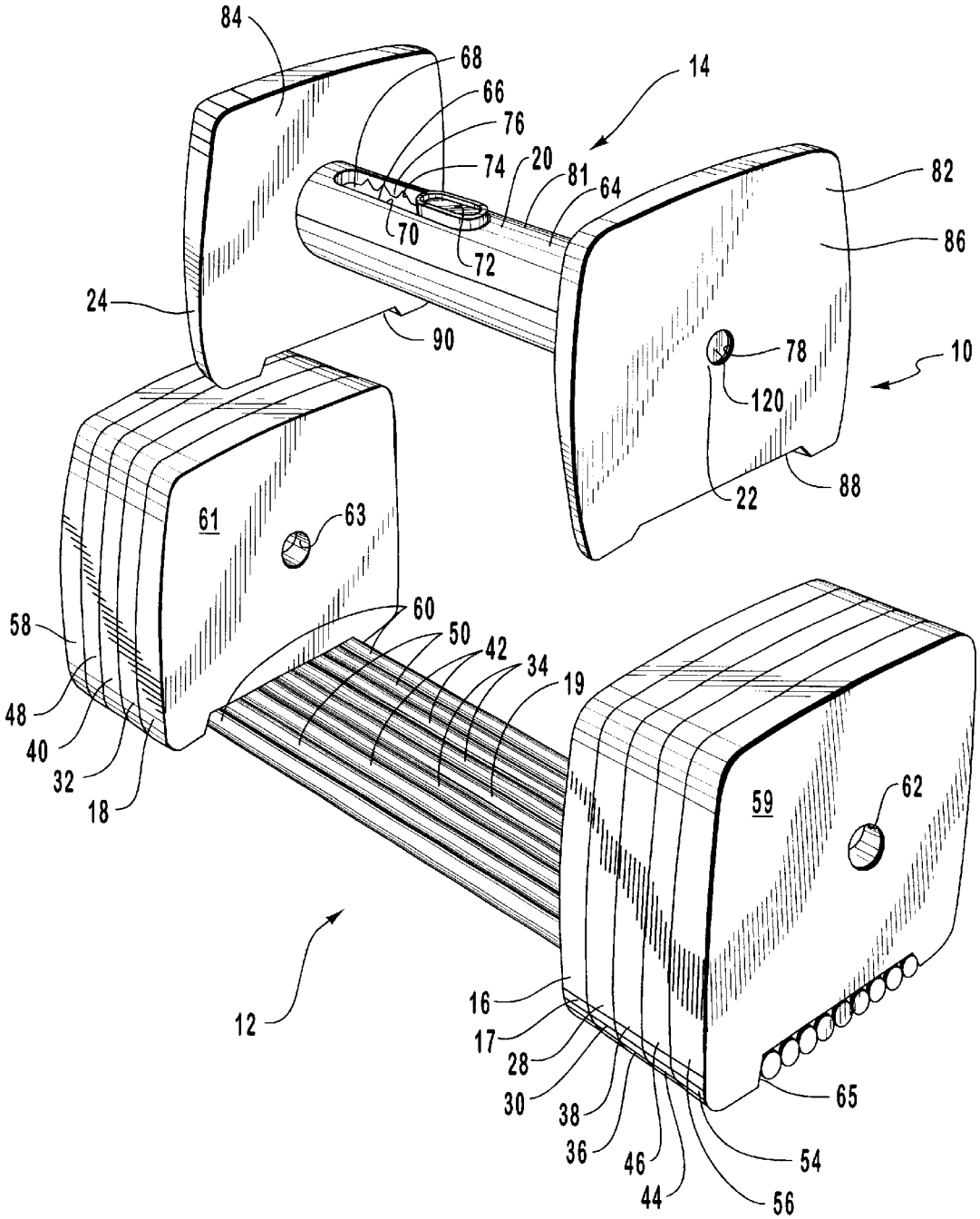
FIG. 1 is a view of one embodiment of the weightlifting system of the present invention with the weightlifting bar shown above a plurality of nested weights.

With reference now to FIG. 1, a weightlifting system 10 of the present invention is shown. Weightlifing system 10 comprises (i) one or more weights 12; and (ii) a weightlifting bar 14 configured to selectively engage the one or more weights 12. First weight 16 of weight nest 12 has a first upstanding end 17, a second upstanding end 18, and a cross member 19 extending therebetween.

Weightlifting bar 14 comprises (i) a handle 20 having first and second opposing ends 22, 24; and (ii) means for selectively attaching each end 22, 24 to a corresponding end 17, 18 of weight 16 when handle 20 is disposed between first end 17 and second end 18 of weight 16. Weightlifting bar 14 is readily placed between first and second ends 17, 18 of weight 16.

System 10 enables the user to select a desired number of weights 12 to be lifted, then conveniently couple the desired weights 12 to weightlifting bar 14. By placing bar 14 within first weight 16, then actuating the attaching means, the user selectively couples one or more weights 12 to bar 14. The user may couple one, two, three, four, five or even more weights 12 to bar 14, depending upon the amount of weight desired to be lifted by the user. If certain weights are not selected by a user, they are maintained in a nested relationship with respect to each other, thereby conserving space. In addition, when the user desires to remove certain weights from weightlifting bar 14, the user is able to readily release the weights from bar 14 and leave the weights in the weight nest 12. System 10 thus conserves space, provides for easy adjustment ofweights 12, and maintains weights on bar 14 without risk of weights 12 falling off.

Weights 12 will now be discussed in additional detail. First weight 16 is shown in FIG. 1 as being nested within second weight 28. Second weight 28 has a first end 30, a second end 32, and a pair of cross members 34 extending between first end 30 and second end 32. A third weight 36 has a first end 38, a second end 40 and a pair of cross members 42 extending between first and second ends 38, 40. A fourth weight 44 includes a first end 46, a second end 48, and a pair of cross members 50 extending between first and second ends 46,48. A fifth weight 54 includes first and second ends 56, 58 and a pair of cross members 60 extending between first and second ends 56, 58.

It will be appreciated that a number of additional weights may be added in the nested relationship between weights 16, 28, 36, 44 and 54. It will also be appreciated that one, two, three or more cross members may be disposed between ends of weights.

Each of the upstanding ends of first and second ends of weights 16, 28, 36, 44 and 54 is preferably comprised of a disk having an aperture 62, 63 extending therethrough. The disk may be a variety of different shapes, sizes or configurations but preferably has planar side faces 59, 61 on opposing sides thereof in order to conveniently and efficiently enable neighboring ends of weights to mate with and be stacked next to each other and to allow weightlifting bar 14 to be disposed between first and second ends 17, 18 of weight 16. In addition, each disk has a slot 65 in a lower portion thereof which receives each cross member corresponding to each disk and allows inner weights to nest atop cross members of neighboring weights.

Cross members 19, 34, 42, 50 and 60 may be coupled to respective weights 16, 28, 36, 44, 54 in a variety of different manners such as by being integrally connected to respective first and second ends, by being welded to respective ends, by being bolted or screwed into respective ends, or in a variety of other methods as is known by those skilled in the art. By being coupled to the lower portions of the first and second upstanding ends of their respective weight, such as by being coupled to the lower surface (as shown in FIG. 1) of the upstanding ends or by being coupled to the lower inside portion of the upstanding ends, the cross members avoid interference with the wrist of the user.

As mentioned, each end of each weight has an aperture 62, 63 extending therethrough. Each weight is also configured such that the apertures 62 in the first upstanding ends of each weight in the nest 12 are in axial alignment and such that the apertures 63 in the second upstanding ends of each weight in the nest 12 are in axial alignment. For example, second weight 28 is configured to receive first weight 16 between ends 30, 32 such that the apertures in the ends 17, 30 are in axial alignment and such that the apertures in ends 18, 32 are in axial alignment.

Since each aperture extending through respective first ends of weights 16, 28, 36, 44 and 54 has the same size and axis as neighboring apertures, a single passageway 62 is formed through each of the first ends of weights 16, 28, 36, 44 and 54. Similarly, since each aperture extending through respective second ends of weights 12, 28, 36, 44 and 54 has the same size and axis as neighboring apertures, a single passageway 63 is formed through each of the second ends of weights 16, 28, 36, 44 and 54. This alignment allows rods from bar 14 to be selectively disposed through one or more weights, as will be discussed in greater detail below.

Weightlifting bar 14 will now be described in additional detail with continued reference to FIGS. 1 and 2. Handle 20 of weightlifing bar 14 has (i) an exterior surface 64; and (ii) an interior surface 66 defining a channel 68 extending between first end 22 and second end 24.

As mentioned above, weightlifting bar 14 includes means for selectively attaching each end 22, 24 of handle 20 to a corresponding end 17, 18 of weight 16 when handle 20 is disposed between first end 17 and second end 18 of weight 16. In the embodiment shown in FIGS. 1 and 2, the means for selectively attaching each end 22, 24 of handle to a corresponding end 17, 18 of weight 16 comprises (i) first and second rods 94, 98 movably disposed within the channel 68 of handle 20; and (ii) means for selectively advancing the first and second rods 94, 98 out of opposing ends of handle 20.

Figure 2:
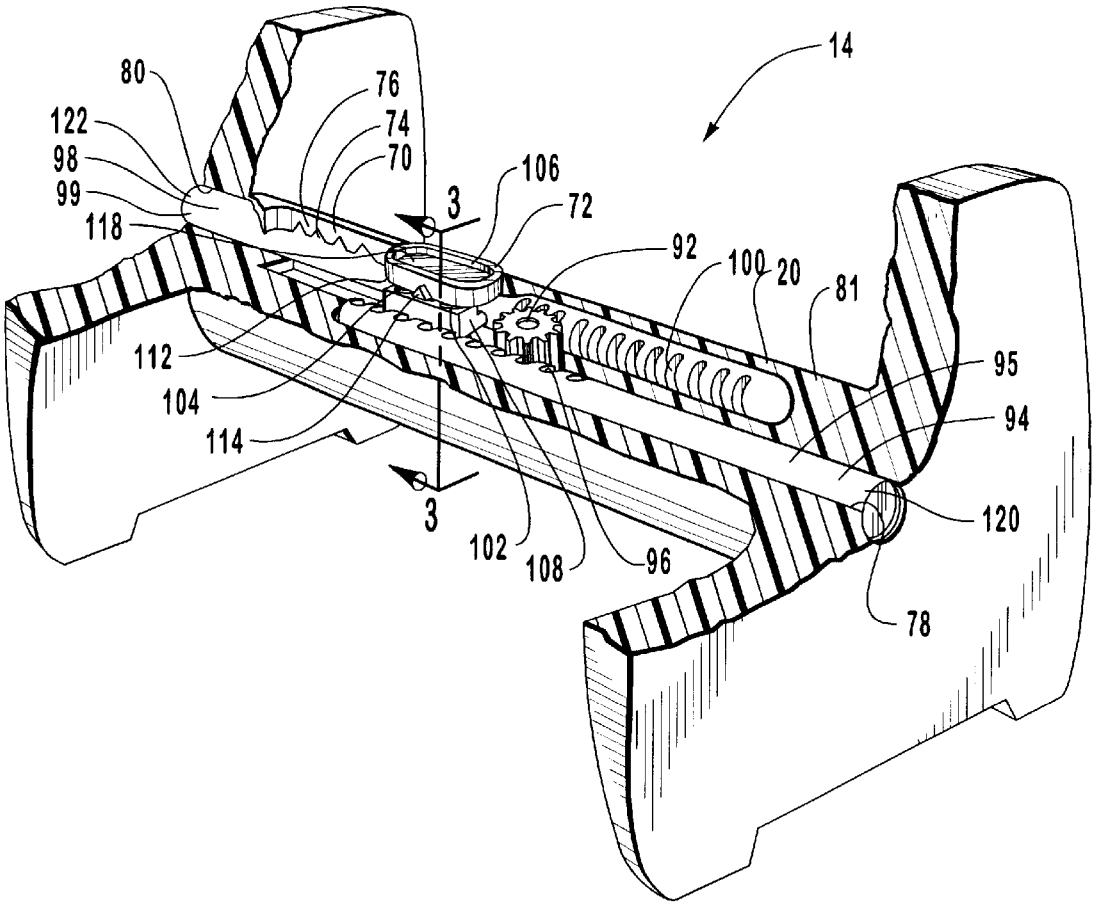
FIG. 2 is a cutaway view of the weightlifting bar of FIG. 1.

In the embodiment shown in FIGS. 1 and 2, the means for selectively advancing the first and second rods 94, 98 out of handle 20 comprises a pinion gear 92 rotatably disposed within channel 68 of handle 20. First rod 94 has a first end 95 positioned at the first end 22 of the handle and an opposing second end having teeth 96 formed along a length thereof, teeth 96 engaging pinion gear 92. Second rod 98 has a first end 99 positioned at the second end 24 of handle 20 and an opposing second end having teeth 100 formed along a length thereof. Teeth 100 of second rod 98 engage pinion gear 92 on a side opposite first rod 94. Pinion gear 92 is pivotally coupled to interior surface 66 of handle 20 through the use of a pin (not shown) disposed Through gear 92 and coupled to interior surface 66.

In one embodiment, the invention further comprises means for selectively advancing the first and second rods 94, 98 in desired increments out of opposing ends 22, 24 of handle 20. This selectively retins rods 94, 98 in a desired, locked position and may also permit the user to select one additional weight for each increment used, for example.

Figure 3:
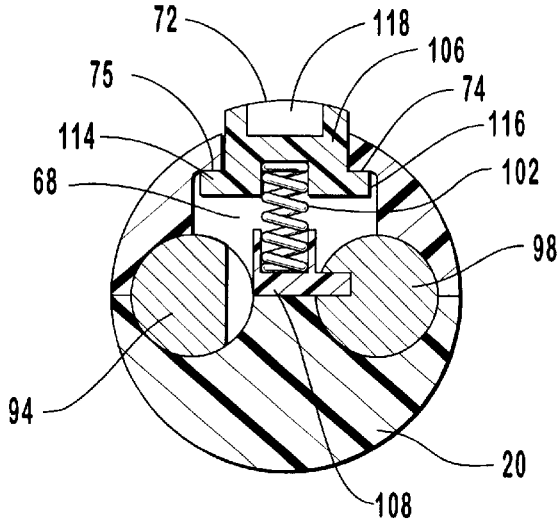
FIG. 3 is a cross-sectional view of the grip of the weightlifting bar shown in FIG. 2 demonstrating a spring-loaded knob which selectively engages a pair of desired slots within the grip.

With reference to FIGS. 1–3, in one embodiment the means for selectively advancing rods 94, 98 in desired increments comprises a springloaded knob 72 coupled to first rod, or, as shown in FIGS. 1–3, second rod 98. Knob 72 selectively engages one of a plurality of longitudinally aligned slots 74 formed along one side of channel 68 and, preferably, one of a plurality of longitudinally aligned slots 75 formed along another side of channel 68. Handle 20 thus preferably includes first and second rows of longitudinally aligned slots 74, 75 formed within the channel, each slot being separated by a tooth 76. Only the first row 74 is featured in FIG. 2, but handle 20 includes an identical row of slots 75 on an opposing side of channel 68. FIG. 3 depicts knob 72 as engaging a pair of slots, 74, 75 one from each of the rows of slots.

Knob 72 is thus preferably configured to selectively engage a pair of desired slots on opposing sides of channel 68, thereby maintaining rods 94, 98 in a desired orientation with respect to handle 20 until knob 72 is selectively moved from the pair of slots by a user. Springloaded knob 72 is selectively depressed in order to move knob 72 between slots.

As shown in FIGS. 2 and 3, knob 72 includes a button 106 and first and second flanges 114, 116 extending from button 106 and configured to selectively engage respective first and second slots 74, 75. Depression of button 106 enables flanges 114, 116 to bypass teeth 76 as knob 72 is adjusted as desired by the user. Thus, if the user desires to lift additional weight, the user moves knob 72 further toward end 24, thereby advancing rods 94, 98 further from handle 20 into additional weights.

As shown in FIGS. 1 and 2, channel 68 includes three openings. Knob 72 selectively moves back and forth within first opening 70 of channel 68. Rod 94 selectively extends through a second opening 78, while rod 98 selectively extends through a third opening 80 in handle 20.

An example of means for coupling knob 72 to rod 98 will now be described with reference to FIGS. 2 and 3. As shown, L-shaped member 108 is disposed within a recess within rod 94, L-shaped member 108 has first and second recesses for receiving first and second springs 102, 104 and a third recess between the first and second recesses for receiving a cylindrically shaped guide pin (not shown in FIGS. 2 and 3). Knob 72 also has recesses in the lower surface 112 thereof for receiving springs 102, 104. In one embodiment, the guide pin extends integrally from the lower surface 112 of knob 72 between springs 102, 104.

The guide pin insures the smooth, aligned movement of knob 72 along a substantially perpendicular axis with respect to the longitudinal axis of handle 20. Springs 102, 104 allow button 106 to be selectively depressed when desired by the user, but maintain knob 72 a nondepressed, desired orientation when knob 72 is not compressed by the user. Button 106 includes an upper recess 118 for placement of the thumb or finger of the user therein, thereby allowing the user to more readily push button 106 to a desired orientation.

Upon depressing button 106, tabs 114, 116 are released from respective slots 74. Thus, knob 72 is freely movable within cavity 68. Upon longitudinal movement of knob 72, second rod 98 moves within cavity 68, causing first rod 94 to move in an opposing direction within cavity 68. Upon outward movement of rod 94, the outer tip 120 of rod 94 extends through opening 78 and into first end 17 of weight 16. Similarly, upon movement of rod 98 outward through opening 80, outer tip 122 of rod 98 is moved into second end 18 of weight 16. Upon further outward movement of knob 72, outer tips 120, 122 of first and second rods 94, 98, respectively, extend into weights 28, 36, 44, 54 and so on as desired while weightlifting bar 14 is disposed within weight nest 12.

In order to selectively remove weights from weightlifting bar 14, outer ends 120,122 are selectively retracted into weightlifting bar 14 by depressing button 106, then sliding button 106 toward the center of handle 20, thereby retracting rods 94, 98 and allowing the desired weights to slide off weightlifting bar 14. In one embodiment, by moving in selected increments, rods 94, 98 pick up or release successive weights.

It will be appreciated that rods 94, 98 may be advanced manually without knob 72 by pressing against one of rods 94, 98, for example. Thus, one embodiment of the means for selectively advancing rods 94, 98 comprises first and second rods 94, 98 and pinion gear 92 without knob 72.

Also as shown in FIGS. 1–3, in one embodiment, handle 20 comprises (i) a cylindrically-shaped, hollow grip 81; and (ii) first and second end plates 82, 84 coupled to opposing sides of grip 81. End plates 82, 84 are preferably flat on the exterior surfaces 86 thereof, thereby providing a smooth mating surface corresponding to the ends of weights 12. However, it will be appreciated that end plates 82, 84 are optional and that weights 12 may also be coupled to handle 20 by being coupled directly to grip 81.

End plates 82, 84 include a respective lower slot 88, 90 which receives cross-members 19, 34, 42, 50 and 60. Thus, weightlifting bar 14 can be conveniently placed in a mating relationship with weight 16 when weightlifting bar 14 is lowered onto the nest of weights 12. Slots 88, 90 also assist by orienting rods 94, 98 into respective apertures 62, 63 when handle 20 is placed onto the cross members of weights 12.

Figure 4:
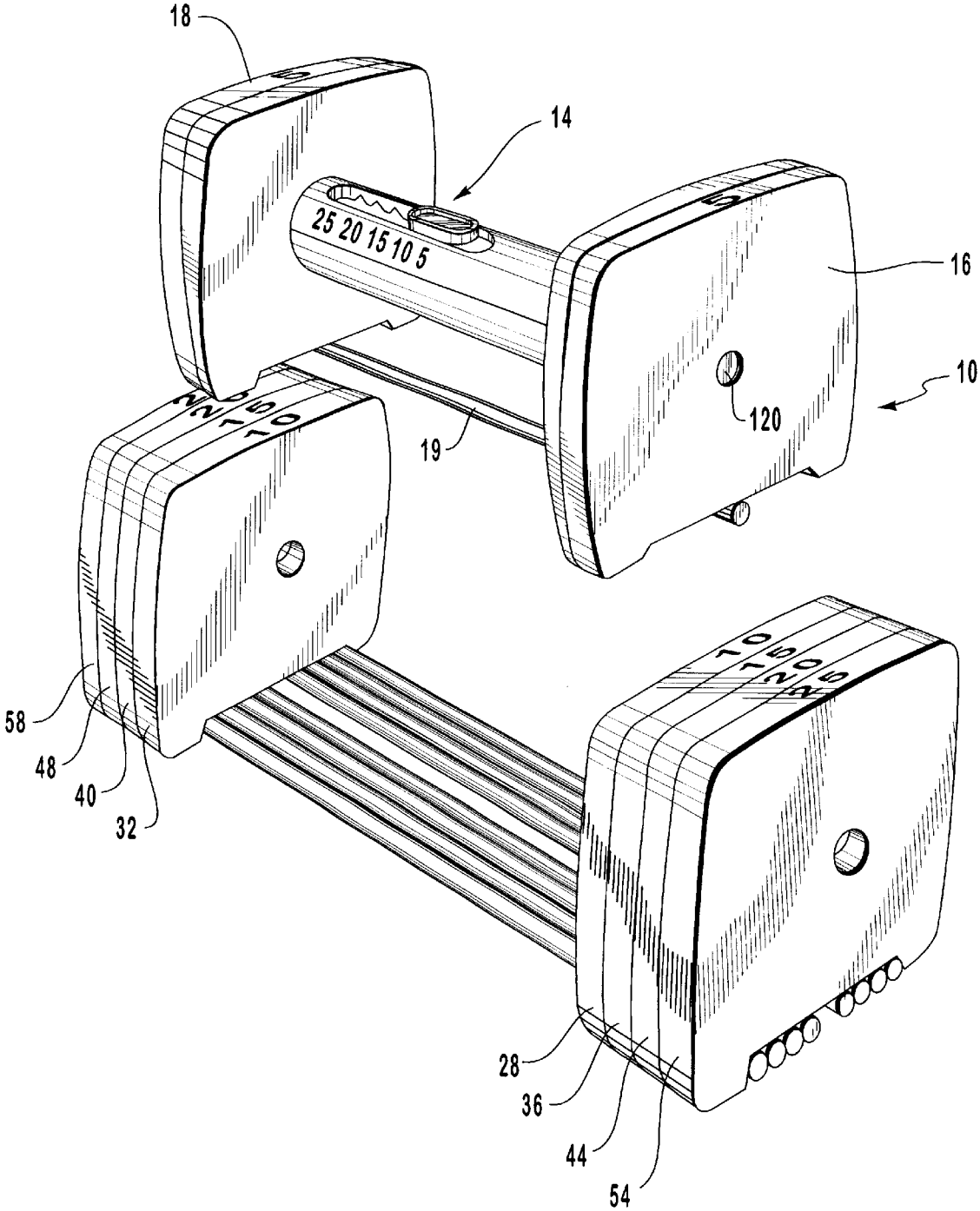
FIG. 4 is a view of the weightlifting bar of FIG. 1 having one of the weights from the weight nest shown in FIG. 1 coupled thereto.

With reference now to FIG. 4, the placement of weight 16 on weightlifting bar 14 is demonstrated. Upon placement of weightlifting bar 14 into the remaining nest of weights 28, 36, 44, 54, weight 16 may be deposited conveniently within the nest or, optionally, additional weights 28, 36, 44, and/or 54 may be grasped by weightlifting bar 14. In one embodiment, ends 120, 122 of rods 94, 98 are tapered at the tips thereof to permit smooth sliding thereof into the ends of desired weights.

Adjustment of the weights coupled to handle 20 may be accomplished using a single hand. Once handle 20 is disposed within weight 16, the user conveniently presses knob 72 (or, optionally one of rods 94, 98) with the user's thumb or finger, thereby advancing rods 94, 98 out of handle 20 and into a desired number of weights. This one-handed weight adjustment capability has many advantages. The user is not required to release the handle 20 in order to adjust the weight. The user may use one hand to hold handle 20 and adjust the weight thereon while another hand performs another operation. In addition, it is possible for the user to hold two different handles 20, i.e., by holding one in each hand, and simultaneously adjust the number of weights on each handle 20.

As further shown in FIG. 4, the weights may have their respective weights stamped thereon or otherwise displayed in order to show the user the total amount of weight lifted. It will also be appreciated that although knob 72 is shown in FIGS. 1–4 as extending slightly above grip 81 of handle 20, it is possible to orient knob 72 within channel 68 such that knob 72 does not extend above grip 81 during use.

In the embodiments shown in FIGS. 1–4, rods 94, 98 are essentially cylindrical. In another embodiment, however, the rods are D-shaped, having a flat surface in which the teeth for coupling with a pinion gear are formed. In this alternative embodiment, there is a corresponding D shape of the holes within the ends of the weights.

Figure 5:
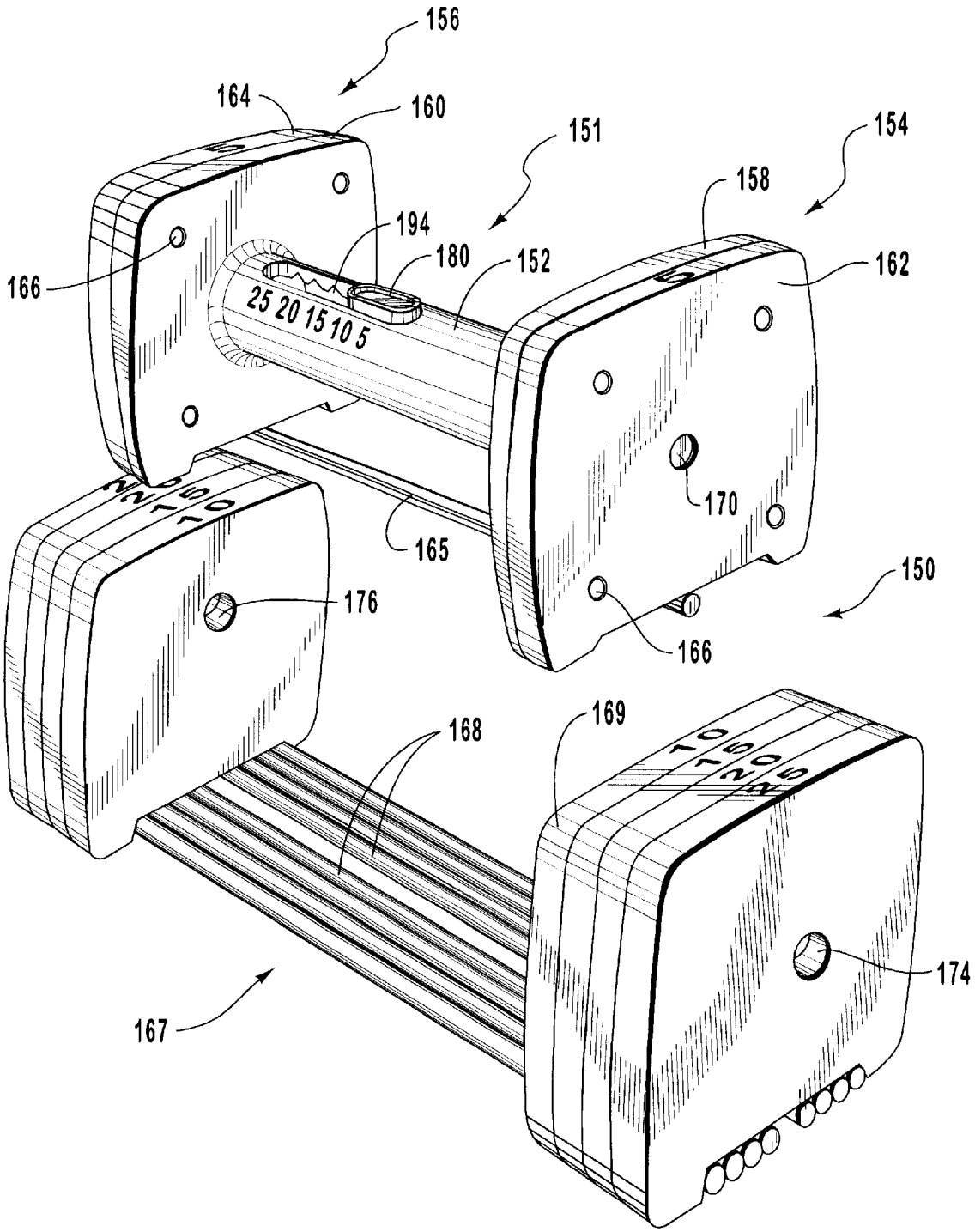
FIG. 5 is a view of yet another embodiment of a weightlifting system of the present invention comprising a handle having a weight affixed thereto.
Figure 6:
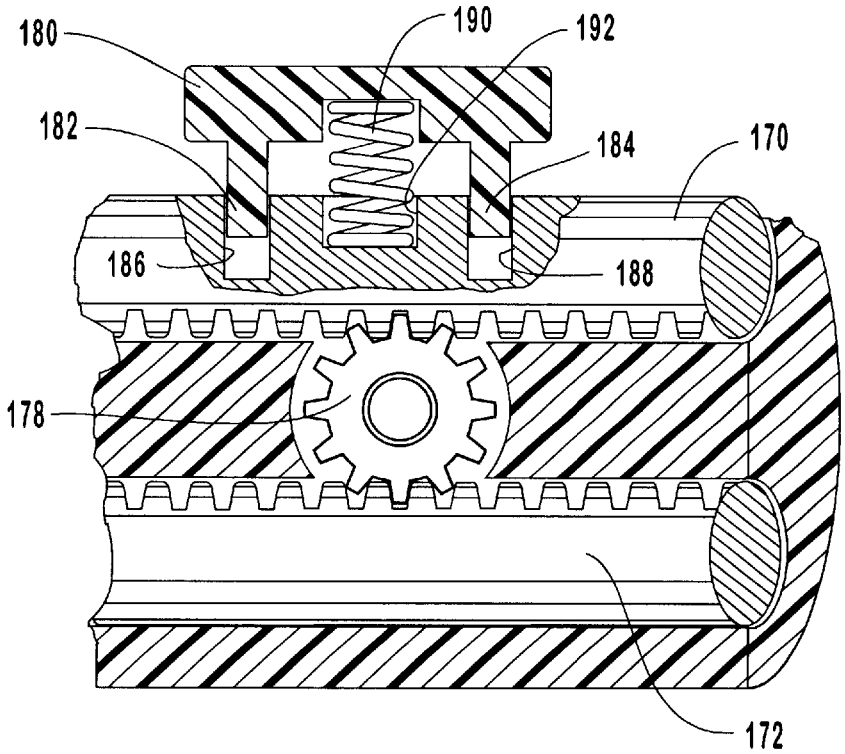
FIG. 6 is a cross sectional, cutaway view of one example of the means for selectively attaching each end of the handle to a corresponding end of the weight when the handle is disposed between the first and second ends of the weight.
Figure 7:
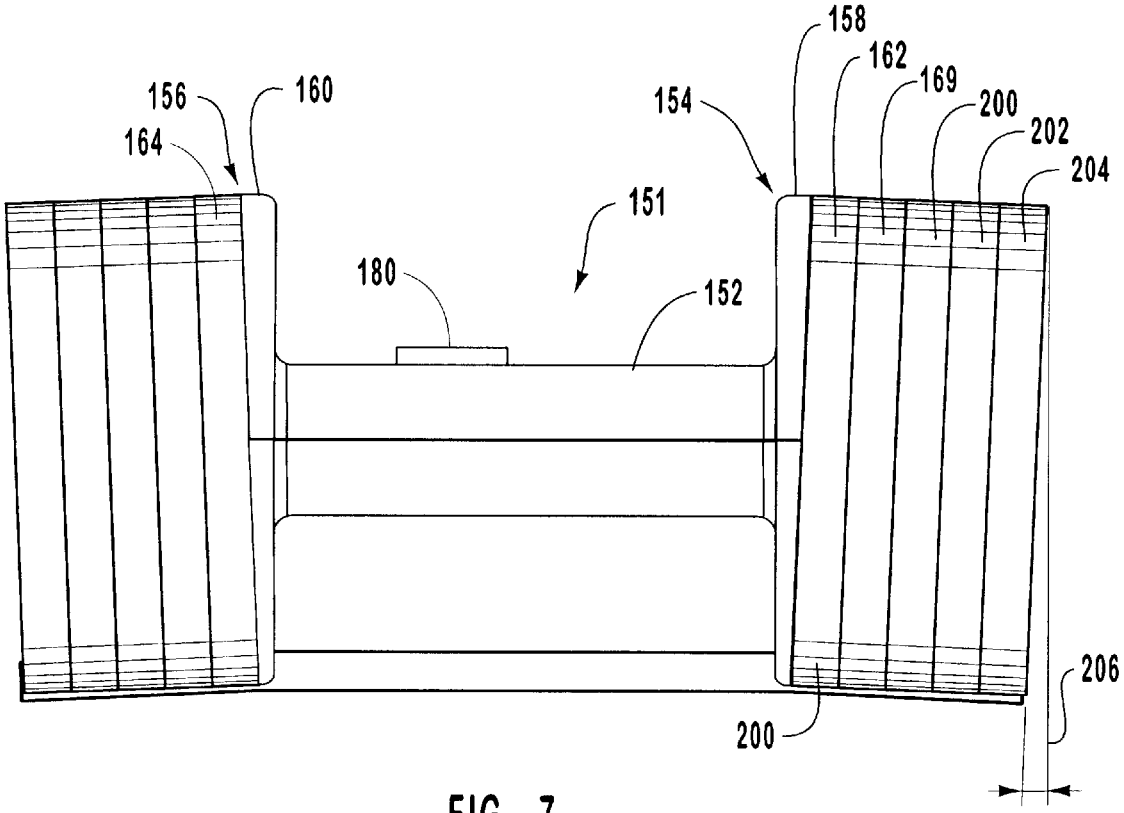
FIG. 7 is aview of the weightlifting system of FIG. 5 showing the handle of the system disposed within the weight nest of the system.

With reference now to FIGS. 5–7, another embodiment of present invention is shown. In the embodiment of the weightlifting system 150 shown in FIG. 5, handle 151 comprises a grip 152 and end plates 154, 156 extending from grip 152. End plates 154, 156 of handle 151 are each comprised of a respective first end plate portion 158, 160 and a respective second end plate portion 162, 164. Second end plate portion 162, 164 is substantially similar to first and second ends 17, 18 of weight 16 shown in FIG. 1.

In the embodiment of FIG. 5, however, fasteners 166 such as screws or bolts or other fasteners are disposed through second end plate portions 162, 164, thereby affixing portions 162, 164 to respective first portions 158, 160. This adds additional weight, such that in one embodiment handle 151 with its portions 162, 164 weighs more than handle 20 for additional resistance in exercising with handle 151. In one embodiment, first end plate portions 158, 160 extend integrally from grip 152. Grip 152 and first and second end plate portions 158, 160 may be comprised of a plastic or metal material, for example. In one embodiment, grip 152 and portions 158, 160 are manufactured in first and second half sections which are combined by being screwed or bolted together (the screws or bolts extending between half sections of the grip) to form a single unit.

In addition, handle 151 further includes a cross member 165 disposed between portions 162, 164, assisting in indexing handle 151 when handle 151 is placed within weight nest 167. When cross member 165 is placed in the appropriate location between cross members 168 of weight 169 of nest 167, the rods 170, 172 of handle 151 are properly aligned to be placed within respective apertures 174, 176 of weights 167.

FIG. 6 is a cross sectional, cutaway view of another example of means for selectively attaching each end of handle, such as handle 151, to a corresponding end of weight, such as weight 169 when handle 151 is disposed between the first and second ends of the weight. As shown in FIG. 6, in one embodiment first and second rods 170, 172 are aligned vertically within handle 151, the pinion 178 being disposed between rods 170, 172.

Also as shown, as another embodiment of a means for coupling knob 180 to rod 170, knob 180 has guide pins 182, 184 extending integrally there from which couple directly into respective recesses 186, 188 within rod 170. A spring 190 is disposed between knob 180 and another recess 192 in rod 170, thereby springloading knob 180. Knob 180 further includes a flange (not shown) which selectively engages a pair of slots 194 (see FIG. 5) within first and second longitudinal rows of slots in handle 151 (second row not shown).

FIG. 7 demonstrates weights 169, 200, 202, 204 being removably coupled to handle 151. As shown in FIG. 7, in one embodiment, each end of each weight 169, 200, 202, 204 and the outer faces of end plates 154, 156 are oriented slightly at an angle outwardly with respect to an axis 206 perpendicular to the longitudinal axis of the grip 152, thereby enabling the weights to conveniently fit within each other and receive bar 151. In another embodiment, the angle is more dramatic.

Yet another example of the means for selectively attaching each end of the handle to a corresponding end of the weight when the handle is disposed between the first end and second end of the weight comprises a single rod moving within the handle rather than two rods having a pinion therebetween.

For example, in one embodiment, a single rod is movably disposed within the channel of the handle. The rod is selectively advanced out of a first end of the handle, by pressing against a springloaded knob on the rod, for example, or by pressing against the rod without a knob. Thus, in the single rod embodiment, the means for selectively advancing the rod may comprise the rod being configured to be pressed by the user out of an aperture in the handle, for example. The springloaded knob may be incrementally advanced within one or more slots in the channel as discussed above with reference to FIGS. 1–4, for example. In one embodiment, the second end of the handle is configured to fit within the aperture of a one end of a weight such as weight 16. Upon placing the second end into one end of the weight such as end 17, then advancing the rod out of the first end of the handle into the second end 18 of the weight, both ends of the handle are selectively coupled to the weight.

The weight lifting system of the present invention has many advantages over previous weightlifting systems. The weighlifting bar may be readily placed within a variety of different weights in order to selectively lift one or more of the weights, thereby allowing the user to select fewer or more weights as desired. The weights are retained within a nested relationship in order to conserve space and the weights are readily placed onto or removed from the weightlifting bar, thereby allowing quick and efficient placement of weights onto the bar and permitting quick and efficient removal of weights therefrom.

Another advantage is that in one embodiment, the weights are weighted equally on opposing sides thereof, thereby providing even weight distribution upon being lifted by a user. Another advantage is that both sides of a weight may be added at the same time. Yet another advantage is that a weight may be added to the handle merely by pushing a button in the intermediate portion of the handle once the handle has been disposed within the weight.

Figure 8:
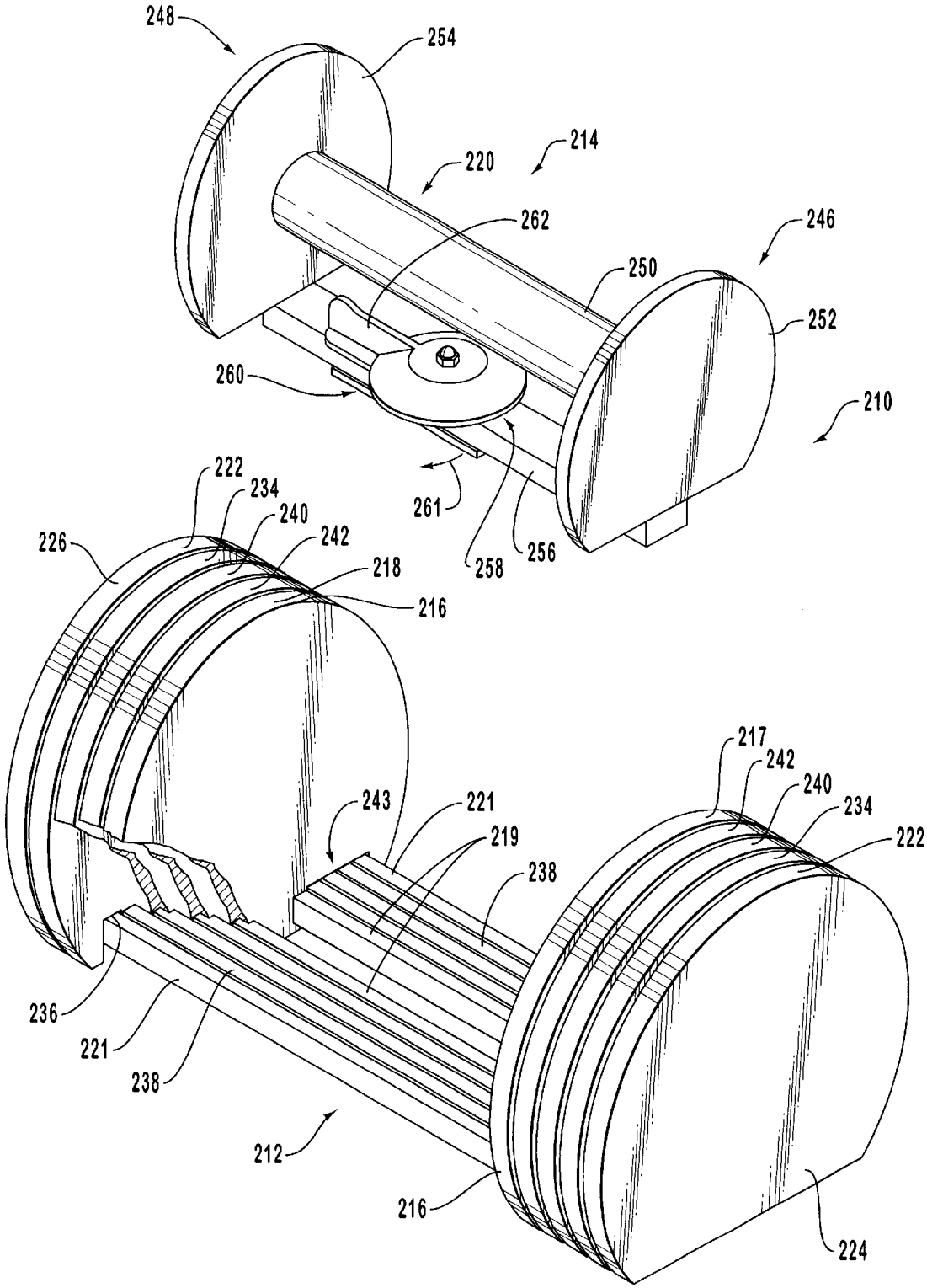
FIG. 8 is a partially cut-away view of another embodiment of a weightlifting system of the present invention. A weightlifting bar is shown above a plurality of nested weights. A rotating gripping member of the weightlifing bar is shown in a neutral position.

With reference now to FIG. 8, another weightlifting system 210 of the present invention is shown. Weightlifting system 210 comprises (i) one or more weights 212; and (ii) a weightlifting bar 214 configured to selectively engage the one or more weights 212. Innermost weight 216 of weight nest 212 has (i) a first upstanding end 217, (ii) a second upstanding end 218; and (iii) at least one and preferably a pair of cross members 219 extending therebetween. Similarly, each weight in nest 212 has first and second upstanding ends and a pair of cross members therebetween. Weight nest 212 is shown in a partially cutaway view.

Weights 212 are nested one on top of the other with the inner weights resting on the outer weights and the cross members of the inner weights located inwardly with respect to the cross members of the outer weights.

The weights of weight nest 212 are also configured such that the cross members of each weight are raised above a support surface. As discussed below, this configuration allows convenient movement of a gripping member 260 of weightlifting bar 214 below the cross members as shown by arrow 261 to thereby engage the cross members. As an example of this configuration, as shown in the embodiment of FIG. 8, the cross members 221 of outermost weight 222 are coupled to the lower, outer portions of respective upstanding ends 224, 226 of weight 222, yet are coupled high enough on upstanding ends 224, 226 to be raised slightly above the support surface.

Weight 234, which is disposed inwardly from outermost weight 222 has (i) a pair of slots 236 on each of the upstanding ends thereof (only one slot 236 of one end shown) for receiving cross members 221 of outermost weight 222; and (ii) a pair of cross members 238 positioned adjacent and inwardly with respect to cross members 221 of outermost weight 222.

Continuing inwardly from weight 234, each successive inner weight 240, 242, 216 has (i) a pair of successively larger slots for receiving the cross members of each of the weights positioned thereunder, and (ii) at least one and preferably a pair of successively inwardly oriented cross members. Innermost weight 216, for example, has a pair of large slots 243 on each end 218, 217 thereof (only one slot 243 of one end 218 shown) for receiving the cross members of weights 222, 234, 240, and 242 therein .

Each of the first and second upstanding ends of each weight 212 is preferably comprised of a plate, which may be a variety of different shapes, sizes or configurations, but preferably has planar side faces on opposing sides thereof for convenient nesting of weights 212.

Weightlifting bar 214 will now be described in additional detail with continued reference to FIG. 8. Weightlifting bar 214 comprises (i) a handle 220 having first and second opposing ends 246, 248; and (ii) means rotatably coupled to handle 220 for selectively coupling one or more weights 212 to handle 220. By placing bar 214 within innermost weight 216, then actuating the rotatable coupling means in the direction of arrow 261 or the opposite direction, the user selectively couples one or more weights 212 to bar 214.

Handle 220 comprises (i) a grip 250; and (ii) a cross member 256 coupled to grip 250. Grip 250 is coupled between opposing ends 246, 248 of handle 220. As shown in FIG. 8, each of the opposing ends 246,248 of handle 220 preferably comprises an end plate 252, 254. Thus, in a preferred embodiment, as shown in FIG. 8, cross member 256 is coupled to grip 250 by being coupled to first and second end plates 252, 254 coupled to opposing ends of grip 250.

Consequently, a space exists between the grip and the cross member for placement of the user's fingers within the space. It will be appreciated, however, that the ends of the handle may have a variety of different shapes and configurations which enable a cross member to be coupled thereto while providing a space between at least a portion of the cross member and the grip.

Cross member 256 of handle 220 is configured to be positioned substantially parallel to and between cross members 219 of weight 216 when handle 220 is positioned between first end 217 of weight 216 and second end 218 of weight 216. Cross member 256 of handle 220 preferably fits in mating relationship between cross members 219 of innermost weight 216, which preferably fit between the cross members of weight 242 in mating relationship, and which preferably fit between the cross members of weight 240 in mating relationship, and so on. Cross member 256 thus assists in indexing handle 220 within weight nest 212.

In the embodiment shown in FIG. 8, the means rotatably coupled to handle 220 for selectively coupling weight 216 to handle 220 comprises means rotatably coupled to cross member 256 for selectively coupling weight 216 to handle 220. One example of such a rotating coupling means coupled to cross member 256 comprises gripping member 260.

Gripping member 260 is rotatably coupled to cross member 256 and rotates as shown by arrow 261 or in an opposite direction.

Gripping member 260 is in a neutral position in FIG. 8, (rather than in a rotated position). While gripping member 260 is in this neutral position, cross member 256 of handle 220 can be lowered between cross members 219 and gripping member 260 can be lowered below the plane of cross members 219. Gripping member 260 is initially lowered through first and second cross members 219 of weight 216 as cross member 256 of handle 220 is positioned between first and second cross members 219 of weight 216. Gripping member 260 can then be selectively rotated from the neutral position of FIG. 8 to an engaged position (e.g., FIG. 11). In the rotated, engaged position, a selected number of cross members of weights 212 are sandwiched between the gripping member 260 and the lower surfaces of the end plates 252, 254 of the handle.

A variety of different engaged positions are available depending upon the number of weights the user desires to lift on a particular occasion. In the event more weights are desired, the user rotates gripping member 260 further, thereby engaging additional cross members of weights in nest 212.

Also as shown in FIG. 8, the rotatable coupling means preferably further comprises plate 258, which is coupled to and rotates in unison with gripping member 260. Plate 258 has a tab 262 thereon. By moving tab 262, gripping member 260 can be conveniently rotated. Tab 262 can be oriented, if desired, so that tab 262 is within the reach of or close to the fingers of the user while the users'palm is on or near grip 250. Consequently, gripping member 260 is convenient to manipulate.

Figure 9:
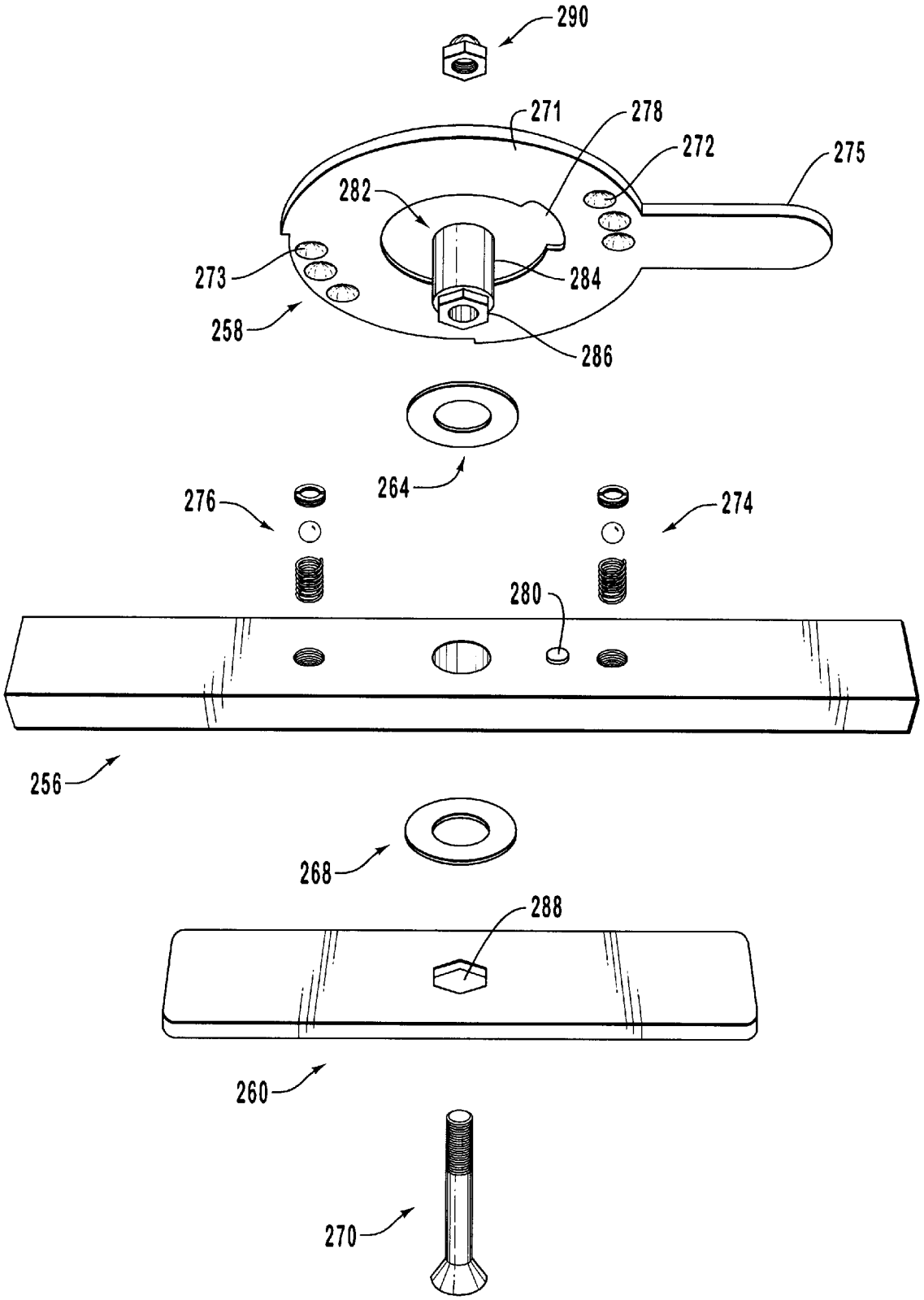
FIG. 9 is an exploded view of the plate, cross member, and gripping member of the weightlifting bar of FIG. 8.

FIG. 9 demonstrates an exploded view of the cross member 256 and rotatable coupling means of FIG. 8. As shown, the rotatable coupling means preferably further comprises upper and lower washers, 264,268 and a screw 270 or pin for coupling plate 258 and member 260 together. Plate 258 preferably comprises a circular disk 271 and a handle 275 coupled to disk 271. Also as shown, gripping member 260 is preferably in the shape of a finger configured to selectively fit between the cross members of the weights in nest 212.

Also in a preferred embodiment, the weightlifting bar comprises means for incrementally rotating gripping member 260. In the embodiment of FIG. 9, the means for incrementally rotating gripping member 260 comprises (i) plate 258 having a plurality of recesses 272, 273; and (ii) at least one and preferably first and second detentes 274, 276 on cross member 256 for engaging selected recesses 272, 273. Detentes 274, 276 are preferably spring-loaded ball detentes.

Also in a preferred embodiment, the weightlifting bar further comprises means for preventing rotation of gripping member 260 past a desired position. An example of this means for preventing overrotation comprises plate 258 being slotted along a lower surface thereof, the slot 278 of plate 258 engaging a raised protuberance 280 or stop on cross member 256 which arrests movement of plate 258 when the end of slot 278 contacts raised protuberance 280.

In the rotated, engaged position of gripping member 260, a selected number of cross members of weights 212 are sandwiched between the gripping member 260 and the ends 246, 248 of handle 220. In one embodiment, plate 258 does not engage cross members of weights, but instead is raised slightly above the surface thereof. Optionally, plate 258 can be configured such that the cross members of weights 212 are sandwiched between plate 258 and gripping member 260 when gripping member 260 is in the rotated position. Thus, another embodiment of the means rotatably coupled to the handle for selectively coupling the weight to the handle comprises an upper rotating, gripping member, e.g., plate 258, and a lower rotating, gripping member, e.g., member 260, which sandwiches cross members of weights 212 therebetween.

Figure 10:
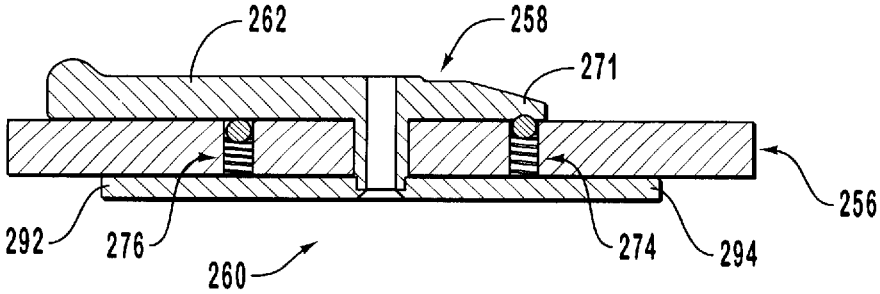
FIG. 10 is a cross sectional side view of the gripping member and plate of FIG. 9 shown as being rotatably coupled to the cross member of FIG. 9.

As an example of means for rotatably coupling plate 258 and gripping member 260 to cross member 256, plate 258 has a hollow axle 282 integrally extending therefrom. Axle 282 extends perpendicularly through cross member 256. A rounded portion 284 of axle 282 is disposed through an aperture in cross member 256, while a hexagon shaped lower portion 286 of axle 282 is disposed into a hexagon shaped aperture 288 in gripping member 260. Screw 270 is positioned through axle 282 and couples to nut 290, thereby coupling plate 258 and member 260, as shown in FIG. 10. Plate 258 and member 260 thus preferably rotate in unison, although in another embodiment, a gripping member rotates while an upper plate is affixed atop cross member 256.

With continued reference to FIG. 10, plate 258 and gripping member 260 are shown rotatably coupled to cross member 256. In one embodiment, the ends 292, 294 of gripping member 260 are tapered and smoothened at the tips thereof to permit smooth rotating of gripping member 260 beneath the cross members of weights 212.

Figure 11:
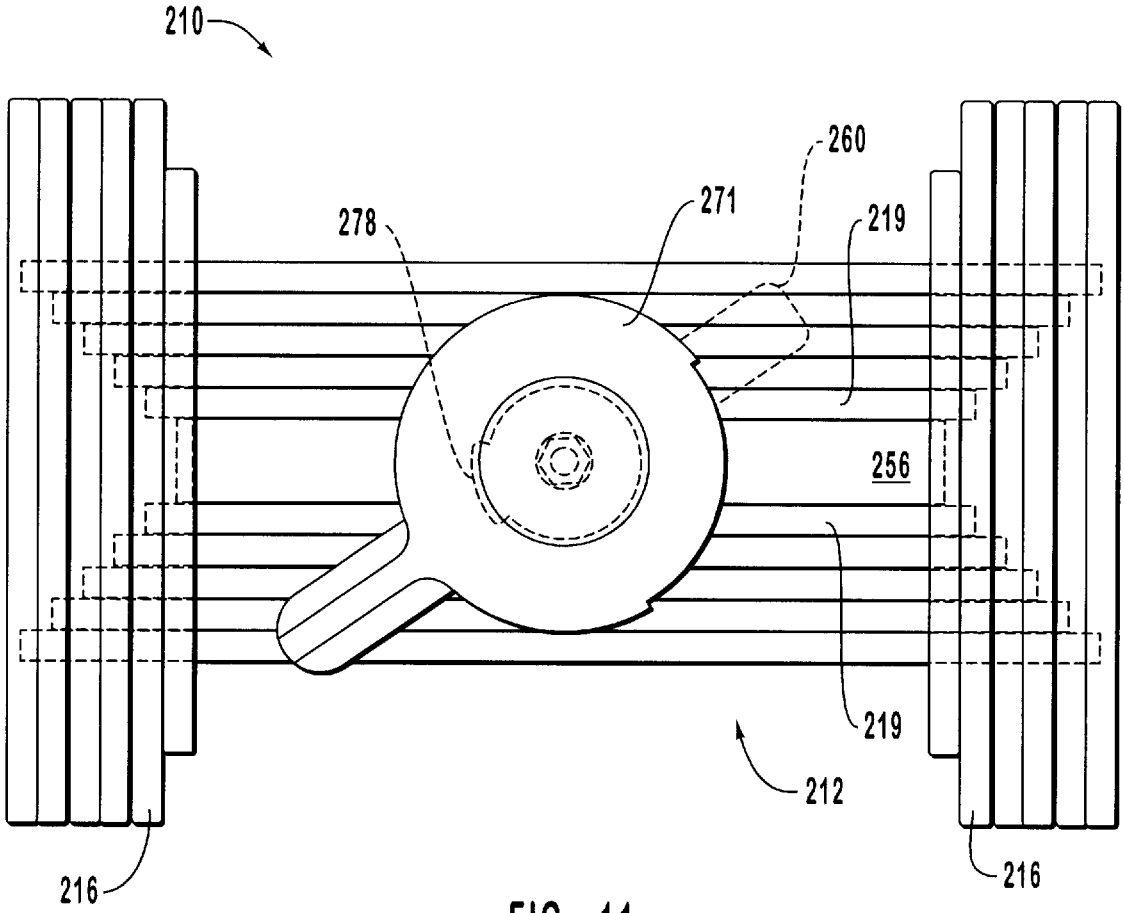
FIG. 11 is a top view of the weight lifting system of FIG. 8 with the gripping member shown in a rotated, engaged position in phantom lines. The ends of the cross members of the weights are also shown in phantom lines.

With reference now to FIGS. 10 and 11, since the cross members of weights 212 are maintained above a support surface, finger-shaped member 260 can be positioned below the plane of the cross members of weights 212. Finger-shaped member 260 can then be selectively rotated below the cross members of weights 212 to thereby engage the cross members of weights 212 and couple one or more weights 212 to handle 220. Finger-shaped member 260 is thus configured to be selectively positioned under the cross members 219 of weight 216 or additional weights from weight nest 212 when handle 220 is positioned between ends 217, 218 of weight 216.

Since tab 262 and/or handle 275 of plate 258 may be placed within reach or close to within reach of the fingers of the user while the user grips handle 220, weights 212 may be conveniently added or removed. Movement of tab 262 enables plate 258 to bypass detentes 274, 276 as rotation thereof is desired by the user.

Figure 12:
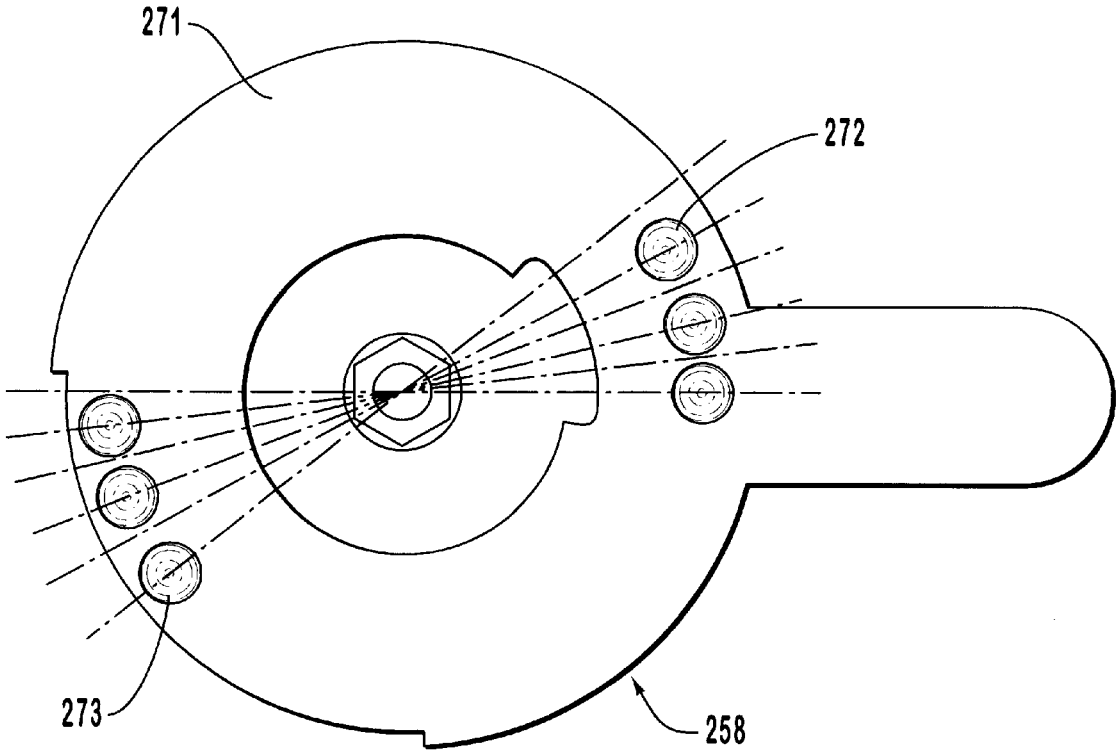
FIG. 12 demonstratates a bottom view of the plate of the weightlifting bar of FIG. 8, showing the offsetting recesses of one embodiment of the plate.

FIG. 12 demonstrates one example of the lower surface of plate 258. The locations of the recesses 272, 273 in plate 258 can be varied depending upon the incremental rotational positions desired. In one embodiment (not shown), the recesses are aligned such that while one recess mates with a detente on one side, another 180° opposing recess mates with a detente on an opposing side.

In another embodiment, however, as shown in FIGS. 10 and 12, recesses 272, 273 on opposing sides of plate 258 are offset with respect to each other. In this offset embodiment, as a detente 274 on one side of cross member 256 mates with one recess 272, the detente 276 on a second opposing side does not mate with a recess 273 on a second opposing side of plate 258. Upon further rotation of member 258, however, recess 273 on the second side of plate 258 mates with the second side detente 276 while the first side detente 274 does not mate with the first side recess 272. In this offset manner, the numbers of incremental positions can be increased.

In light of the rotating coupling means of weightlifting bar 214, bar 214 is convenient to use and store. Rather than employing a coupling means which is subject to being possibly lost or misplaced, the rotating coupling means can be permanently or removably coupled to handle 220. Furthermore, the rotating coupling means is operable by merely actuating a tab 262, rather than requiring more complex manipulation of parts.

Furthermore, selection of weights 212 may be accomplished using a single hand. Once handle 220 is disposed within weight 216, the user conveniently moves tab 262 with the user's thumb or finger, thereby rotating member 260 under a desired number of cross members of weights 212. This one-handed weight selection capability has many advantages. The user is thus not required to release handle 220 in order to adjust the weight. The user may use one hand to hold handle 220 and adjust the weight thereon while another hand performs another operation. In addition, it is possible for the user to hold two different handles 220, i.e., by holding one in each hand, and simultaneously adjust the number of weights on each handle 220. In addition, the rotatable coupling means is conveniently rotated in desired increments and is locked in desired incremental positions.

While gripping member 260 has been described as an example of means rotatably coupled to handle 220 for selectively coupling a weight to handle 220, other rotatable coupling means may be employed in the present invention. One such rotatable coupling means comprises a U-shaped, C-shaped, or L-shaped clip or hook rotatably coupled to an end 246 of bar 214, to cross member 256, or to grip 250. Upon rotation of the clip or hook, one or more weights 212 is selectively coupled to bar 214.

In another embodiment, a rotatable coupling means is coupled directly to the lower surface of the grip of the handle. In this embodiment, the cross members of the weight(s) can be selectively sandwiched between (i) the rotating coupling means; and (ii) the grip or the ends of the handle, for example.

The present invention may be embodied in other specific forms without departing from its spirit or essential chacteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A weight lifting system, comprising:

a weight having an upstanding first end, an upstanding second end, and a cross member extending therebetween;

a handle, wherein the handle comprises a grip and a cross member coupled to the grip, at least a portion of the cross member being spaced apart from the grip; and means rotatably coupled to the handle for selectively coupling the weight to the handle wherein the means rotatably coupled to the handle for selectively coupling the weight to the handle comprises means rotatably coupled to the cross member of the handle for selectively coupling the weight to the handle when the handle is disposed between the first end of the weight and the second end of the weight, and wherein the means rotatably coupled to the cross member of the handle for selectively coupling the weight to the handle comprises a gripping member rotatably coupled to the lower portion of the cross member of the handle and configured to directly engage the weight.

2. A weight lifting system comprising:

a weight having an upstanding first end, an upstanding second end, and a cross member extending therebetween.

a handle; and means rotatably coupled to the handle for selectively coupling the weight to the handle.

wherein the handle comprises a grip and a cross member coupled to the grip, at least a portion of the cross member being spaced apart from the grip;

wherein the means rotatably coupled to the handle for selectively coupling the weight to the handle comprises means rotatably coupled to the cross member of the handle for selectively coupling the cross member of the handle to the cross member of the weight when the handle is disposed between the first end of the weight and the second end of the weight, and wherein the means rotatably coupled to the cross member of the handle for selectively coupling the cross member of the handle to the cross member of the weight comprises a gripping member rotatably coupled to the lower portion of the cross member of the handle.

3. A weight lifting system as recited in claim 2, wherein the cross member is coupled to opposing ends of the handle, the grip being coupled between the opposing ends of the handle.

4. A weight lifting system as recited in claim 3, wherein the cross member of the weight is selectively sandwiched between the ends of the handle and the gripping member.

5. A weight lifting system as recited in claim 4, wherein each of the ends of the handle comprises an end plate.

6. A weight lifting system, comprising:

a weight having an upstanding first end, an upstanding second end, and a cross member extending therebetween;

a handle comprising: (i) a grip; and (ii) a cross member coupled to the grip; and means rotatably coupled to the cross member of the handle for selectively coupling the weight to the handle when the handle is disposed between the first end of the weight and the second end of the weight, wherein the means rotatably coupled to the cross member of the handle for selectively coupling the weight to the handle comprises a gripping member configured to be selectively positioned under the cross member of the weight when the handle is positioned between the first end of the weight and the second end of the weight.

7. A weight lifting system as recited in claim 6, further comprising a second cross member extending between the upstanding ends of the weight wherein the gripping member is configured to selectively engage the first and second cross members of the weight when the handle is positioned between the first end of the weight and the second end of the weight.

8. A weight liftng system as recited in claim 7, wherein the cross member of the handle is configured to be positioned between the first and second cross members of the weight when the handle is positioned between the first end of the weight and the second end of the weight.

9. A weight lifting system as recited in claim 6, wherein the cross member of the handle is coupled to first and second end plates of the handle, the first and second end plates being coupled to opposing ends of the grip.

10. A weight lifting system comprising:

a weight having an upstanding first end, and and upstanding second end, and first and second cross member extending therebetween;

a handle comprising:(i) a grip; and (ii) a cross member coupled to the grip and means rotably coupled to the cross member of the handle for selectively coupling the weight to the handle when the handle is positioned between the first end of the weight and the second end of the weight.

wherein the means rotably coupled to the cross member of the handle for selectively coupling the weight to the handle comprises a gripping member configured to be selectively positioned under the first and second cross members of the weight when the handle is positioned the first end of the weight and the second end of the weight.

11. A system as recited in claim 10, wherein the cross members of the weight are configured to be raised above a support surface when the upstanding ends of the weight are positioned on the support surface such that the gripping member can be selectively positioned below the cross members.

12. A weight lifting system comprising:

a weight having an upstanding first end an upstanding second end, and a cross member extending therebetween;

a handle, and a gripping member rotatably coupled to the handle for selectively coupling the weight to the handle when the handle is disposed between the first end of the weight and the second end of the weight, wherein the handle comprises a g rip and a cross member coupled to the grip, at least a portion of the cross member being spaced apart from the grip, wherein the gripping member is rotatably coupled to a lower surface of the cross member, wherein the cross member of the handle is coupled to first and second ends of the handle, the grip being coupled between the first and second ends of the handle, and wherein the handle is configured such that the cross member of the weight is selectively sandwiched between the ends of the handle and the gripping member.

13. A weight lifting system as recited in claim 12, further comprising means for incrementally rotating the gripping member.

14. A system as recited in claim 12, further comprising an axle extending through the cross member of the handle and having an axis transverse to the axis of the cross member, wherein the gripping member is coupled to the axle.

15. A system as recited in claim 17, wherein the weight comprises first and second cross members extending between the first and second upstanding ends of the weight.

16. A weight lifting system, comprising a weight having an upstanding first end, an upstanding second end, and first and second spaced apart cross member extending between the first upstanding end and the second upstanding end;

a handle having (i) opposing ends; (ii) a grip coupled between the opposing ends of the handle; and (iii) a cross member coupled to the opposing ends of the handle and spaced apart from the grip;

a gripping finger rotably coupled to a lower portion of the cross member to selectivley couple the weight to the handle when the cross member of the handle is positioned between the cross members of the weight; the gripping finger configured to be selectively disposed between and beneath the cross members of the weight.

17. A weight lifting system as recited in claim 16, further comprising means for preventing rotation of the gripping member past a desired position.

18. A system as recited in claim 16, wherein each of the opposing ends of the handle comprises an end plate.

19. A weight lifting system, comprising:

a weight having an upstanding first end, an upstanding second end, and first and second spaced apart cross members extending between the first upstanding end and the second upstanding end;

a handle having (i) opposing ends; (ii) a grip coupled between the opposing ends of the handle: and (iii) a cross member couled to the opposing ends of the handle and spaced apart from the grip;

a gripping member rotatably coupled to a lower portion of the cross member for selectively coupling the weight to the handle when the cross member of the handle is positioned between the cross members of the weight, wherein the gripping member comprises a gripping finger, the gripping finger configured to be selectively disposed between and beneath the cross members of the weight.

20. A weight lifting system, comprising:

a weight having an upstanding first end, an upstanding second end, and first and second spaced apart cross members extending between the first upstanding end and the second upstanding end;

a handle having (i) opposing ends; (ii) a grip coupled between the opposing ends of the handle; and (iii) a cross member coupled to the opposing ends of the handle and spaced apart from the grip; and a gripping member rotatably coupled to a lower portion of the cross member for selectively coupling the weight to the handle when the cross member of the handle is positioned between the cross members of the weight, wherein the handle is configured such that the cross members of the weight are selectively sandwiched between the ends of the handle and the gripping member.

21. A weight lifting system, comprising:

a weight having an upstanding first end, an upstanding second end, and a cross member extending therebetween;

a handle comprising a grip and a cross member coupled to the grip, at least a portion of the cross member being spaced apart from the grip; and a gripping member rotatably coupled to the cross member of the handle, the gripping member configured to selectively couple the weight to the handle when the handle is disposed between the first end of the weight and the second end of the weight, a portion of the gripping member configured to be selectively positioned below the cross member of the weight so as to selectively couple the weight to the handle.

* * * * *

UNITED STATES PATENT AND TRADEMARK OFFICE

CERTIFICATE OF CORRECTION

PATENT NO. : 6,261,022 B1 
DATED : July 17, 2001
INVENTOR(S) : William T. Dalebout, Patrick J. Hald and Rodney Hammer It is certified that error appears in the above-identified patent and that said Letters Patent is hereby corrected as shown below:

Column 1,
Line 22, before "attached" change "integrityrally" to -- integrally --

Column 2,
Line 18, after "internal" change "band" to -- hand --

Column 4,
Line 63, before "of the weightlifting" change "aview" to -- a view --

Column 5,
Line 2, before "bar" change "weightlifing" to -- weightlifting --

Column 7,
Line 9, after "disposed" change "Through" to -- through --
Line 14, after "selectively" change "retins" to -- retains --
Line 23, after "outer ends" change "120,122" to -- 120, 122 --

Column 9,
Line 54, after "167." delete the comma
Line 65, after "integrally" change "there from" to -- therefrom --

Column 10,
Line 33, after "aperture of" delete "a"

Column 12,
Line 16, before "Gripping" do not start a new paragraph

Column 15,
Line 13, after "system" insert a comma
Line 63, after "weight" insert a comma Column 16,
Line 11, after "first end," change "and and" to -- an --

UNITED STATES PATENT AND TRADEMARK OFFICE

CERTIFICATE OF CORRECTION

PATENT NO. : 6,261,022 B1 
DATED : July 17, 2001
INVENTOR(S) : William T. Dalebout, Patrick J. Hald and Rodney Hammer It is certified that error appears in the above-identified patent and that said Letters Patent is hereby corrected as shown below:

Column 16,
Line 26, before "the first" insert -- between --
Line 34, after "system" insert a comma
Line 35, after "first end" insert a comma
Line 43, after "comprises a" change "g rip" to -- grip --
Line 62, after "claim" change "17" to -- 12 --

Column 17,
Line 25, after "handle" change ":" to -- ; --
Line 26, after "member" change "couled" to -- coupled --

Signed and Sealed this

Fifth Day of August, 2003

JAMES E. ROGAN
*Director of the United States Patent and Trademark Office*